United States Patent [19]

Weems

[11] 3,980,188

[45] Sept. 14, 1976

[54] METHOD FOR HANDLING NUCLEAR FUEL CASKS

[75] Inventor: Sterling J. Weems, Chevy Chase, Md.

[73] Assignee: MPR Associates, Inc., Washington, D.C.

[22] Filed: May 14, 1975

[21] Appl. No.: 577,395

Related U.S. Application Data

[60] Division of Ser. No. 507,858, Sept. 20, 1974, Pat. No. 3,945,509, which is a continuation-in-part of Ser. No. 224,495, Feb. 8, 1972, abandoned.

[52] U.S. Cl. ..... 214/152; 176/30

[51] Int. Cl.[2] ..... B66C 5/02

[58] Field of Search ..... 214/16 B, 17 R, 17 B, 214/17 C, 18 N, 86, 87, 127, 152; 176/30, 31, 32; 193/3, 38, 40

[56] References Cited

UNITED STATES PATENTS

| | | | |
|---|---|---|---|
| 2,806,819 | 9/1957 | Christy et al. | 176/32 |
| 3,819,066 | 6/1974 | Jones | 214/16 B |
| 3,836,430 | 9/1974 | Frisch et al. | 176/30 |
| 3,863,770 | 2/1975 | Shallenberger et al. | 214/152 |

*Primary Examiner*—Stephen G. Kunin
*Assistant Examiner*—Charles E. Frankfort
*Attorney, Agent, or Firm*—Boris Haskell

[57] ABSTRACT

A heavy shielded nuclear fuel cask is lowered into and removed from a water filled spent fuel pool by providing a vertical guide tube in the pool, affixing to the bottom of the cask a base plate that approximates the transverse dimension of the guide tube, and lowering and elevating the cask and base plate assembly into and out of the pool by causing it to traverse within the guide tube. The guide tube and base plate coact to function as a dashpot, thereby cushioning and controlling the fall of the cask in the pool should it break loose while being lowered into or raised out of the pool. A specified approach path to the guide tube insures that the cask assembly will not fall into the pool, should it break loose on its approach to the guide tube.

10 Claims, 7 Drawing Figures

FIG. 1
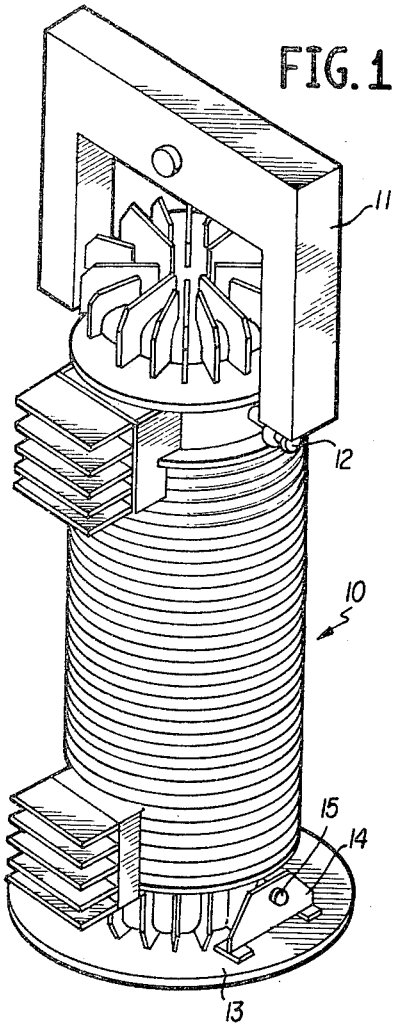
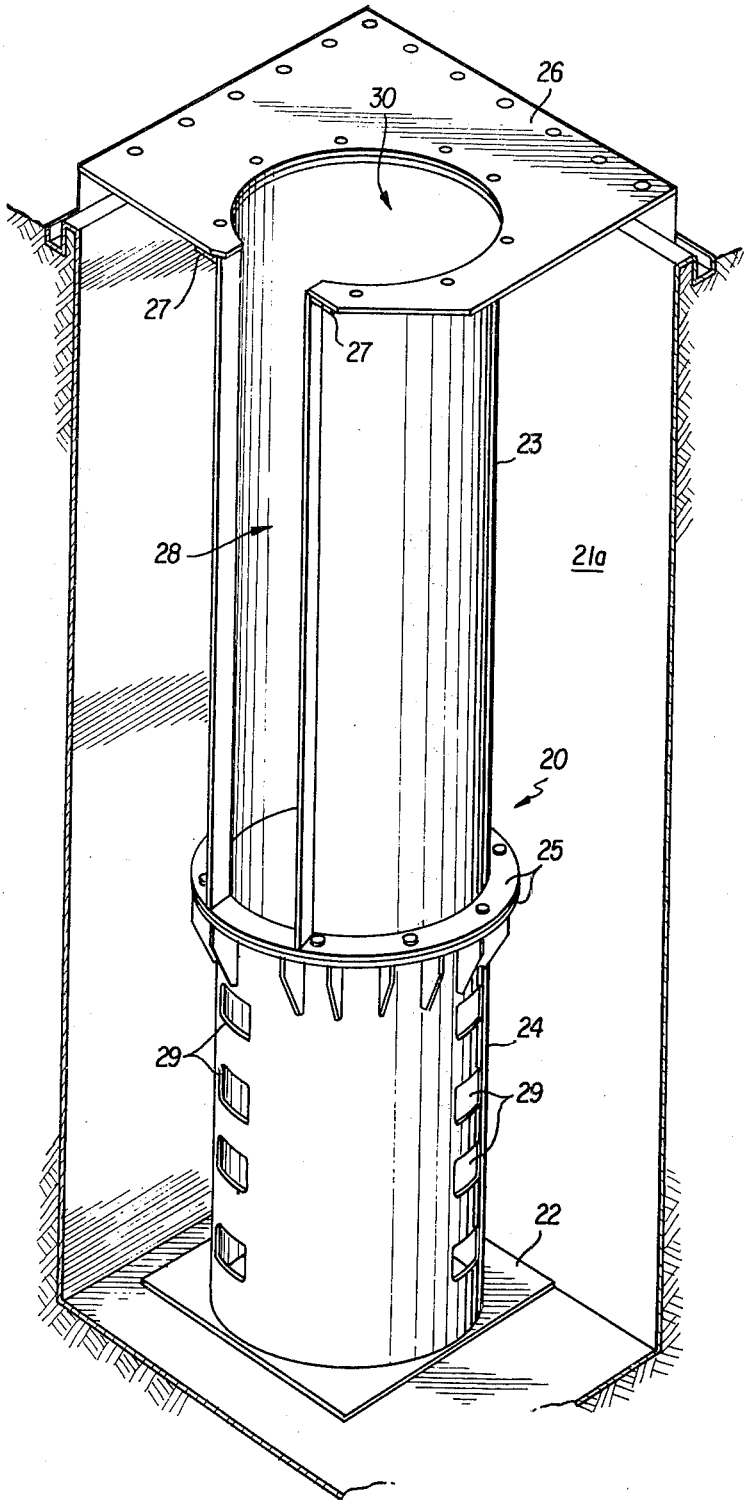
FIG. 2

METHOD FOR HANDLING NUCLEAR FUEL CASKS

CROSS REFERENCE TO RELATED APPLICATIONS

This is a division of application Ser. No. 507,858, filed Sept. 20, 1974, now U.S. Pat. No. 3,945,509, which is a continuation in part of application Ser. No. 224,495, filed Feb. 8, 1972, now abandoned.

INTRODUCTION AND SUMMARY OF INVENTION

The present invention relates to the field of article handling, and more particularly is concerned with the handling of fuel casks utilized in nuclear reactor installations.

In the operation of nuclear reactor installations, such as nuclear power plants, it is necessary from time to time to change the fuel charge, as a particular charge within the reactor becomes spent. The spent charge is, of course, quite radioactive, and appropriate shielding precautions must be taken in its removal and handling. Transportation of spent fuel charges is accomplished in heavily shielded fuel casks, that may weigh as much as 100 tons. At the nuclear plant site, the fuel casks are placed under water in an area known as the spent fuel storage pool. This storage pool is located adjacent to, and is connected with a main reactor cavity pool, in such relationship that spent nuclear fuel assemblied may be extracted from the reactor, transported to the spent fuel storage pool, stored on racks in the pool until their radioactivity decreases to an appropriate level, then loaded into fuel casks for removal, with all these operations being accomplished while retaining the radioactive fuel assemblies under water shielding at all times. At the time that it is desired to remove spent fuel from the spent fuel pool, a fuel cask is placed in the pool, and spent fuel assemblies are placed in the cask for removal and transportation to, for example, a fuel reprocessing plant.

It is therefore necessary, from time to time, to place fuel casks in and remove them from the storage pool. As mentioned previously, these shielded casks are very heavy, weighing as much as 100 tons. Great care must be taken to insure against dropping these casks in the process of introducing them into, or removing them from the storage pool. Dropping a cask of this weight could not only cause serious and expensive structural damage to the pool, but such damage could result in a loss of shielding water from the pool with resultant radiation hazards. Furthermore, a falling cask could seriously damage spent fuel assemblies stored in the pool, and/or damage the cask itself.

The present invention is addressed to the problem of positioning fuel casks in a storage pool and removing the casks therefrom, and eliminating or minimizing the risks of structural damage and radiation hazard should a cask be dropped in this process. The basic concept of the present invention is to locate a cask receiving guide tube at an appropriate position within the pool, preferably in a corner of the pool. The transverse dimensions of the guide tube are substantially larger than those of the cask per se, but before introducing the cask into the pool, the cask is fitted on its bottom end with a plate that approximates but is smaller than the transverse dimensions of the guide tube. Thus, as a cask is lowered into a guide tube, the plate functions as a piston and the guide tube as a cylinder therefor, providing a dashpot effect. In this way, should the cask break loose from a crane or hoist mechanism during removal from or insertion into a guide tube, its rate of fall would be controlled and cushioned by the dashpot effect, thereby creating no significant danger. Additionally, the guide tube would constrain the cask to a substantially upright position and restrain the falling cask from toppling over and colliding with the fuel racks or side wall of the pool.

Also, the cask might break loose and fall while being transported to the guide tube. It is important that the cask not fall into the pool under these circumstances, for the reasons expressed above. The present invention is directed to a particular approach path to the guide tube, to insure that the cask does not fall into the pool should it break loose at any point in its traverse.

It is therefore on object of the present invention to provide for the safe introduction and removal of nuclear fuel casks from the spent fuel storage pool of a nuclear reactor plant.

Another object of the present invention is to insure against damage to fuel, casks and pool structure in the handling of fuel casks in the spent fuel storage pool of a nuclear reactor plant.

Other objects and advantages of the present invention will become apparent to those skilled in the art from a consideration of the following detailed description of one exemplary embodiment of the invention, had in conjunction with the accompanying drawings in which like numerals refer to like or corresponding parts, and wherein:

BRIEF DESCRIPTION OF DRAWINGS

FIG. 1 is a perspective view of a conventional fuel cask, modified for the practice of the present invention;

FIG. 2 is a perspective view of one embodiment of a guide tube which may be utilized in the practice of the present invention;

DETAILED DESCRIPTION

Figure 3:
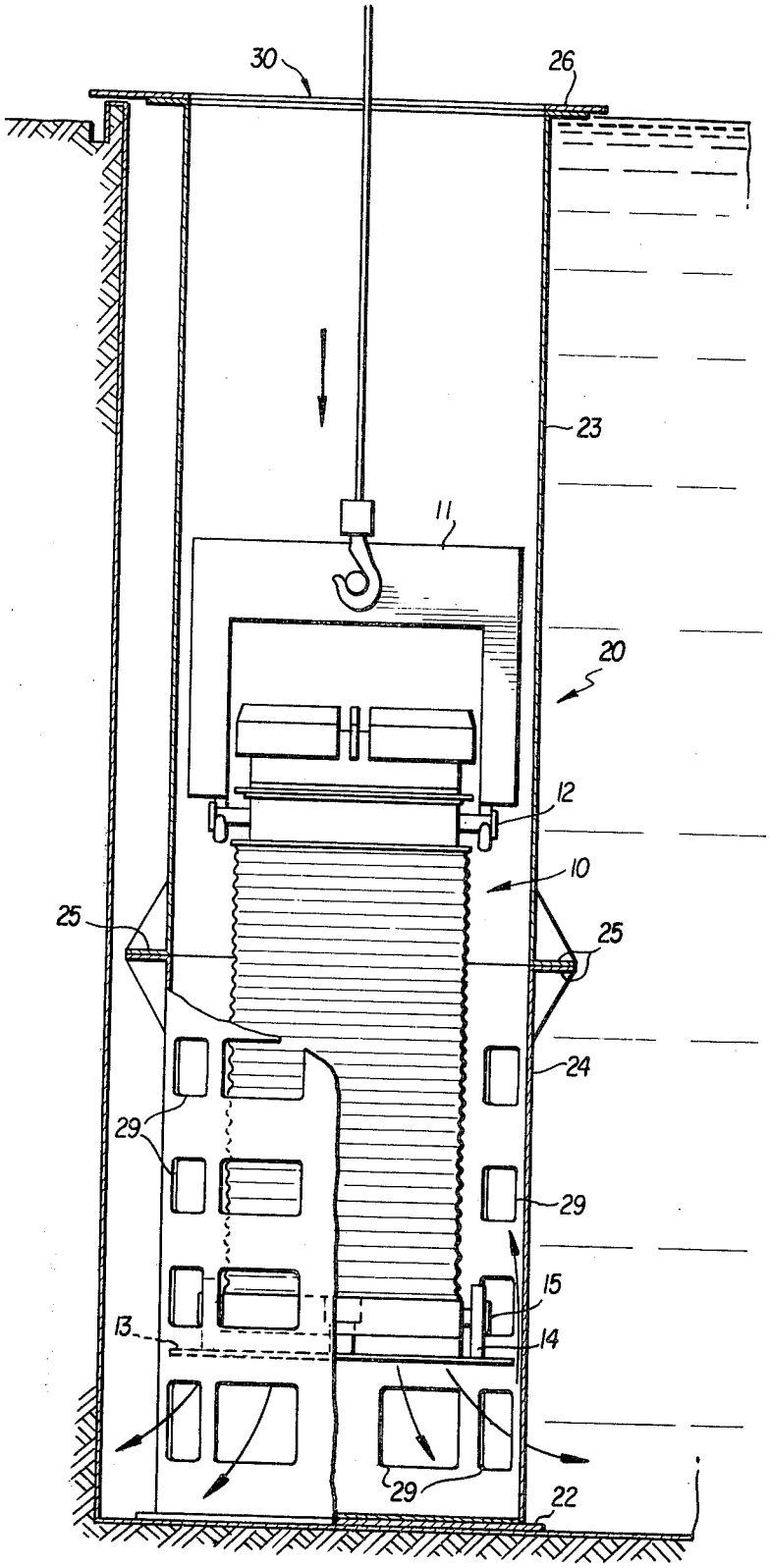
FIG. 3 is a vertical sectional view of the guide tube of FIG. 2 with the cask of FIG. 1 being lowered therein.

Referring to FIG. 1, numeral 10 generally designates a nuclear fuel cask. The basic cask itself constitutes no part of the present invention, and therefore is not illustrated or described in detail. It is basically a stainless steel container with heavy lead exterior shielding. Appropriate finned or corrugated structure is provided to facilitate heat dissipation from within the cask. Access to the interior storage compartment of the cask is had through a removable top. In FIG. 1, in addition to the cask itself, a lifting rig is shown in the form of a yoke 11, which removably engages the lugs 12, whereby a crane or hoist may lift, transport and lower the cask.

In accordance with the present invention, a base plate 13 is affixed to the bottom or base of the cask 10. The plate 13 is substantially larger in diameter than the cask 10, and may be mounted removably or permanently to the cask by means of brackets 14 and pins 15.

The guide tube 20 is shown in FIG. 2 positioned in the corner of a concrete spent fuel pool 21 lined with stainless steel 21*a*. The tube 20 rests upon a reinforcing plate 22 on the bottom of the pool. Pool 21 would normally be filled with water to a point near its top. The tube 20 is shown as essentially cylindrical, and comprising a top guide section 23 and a bottom dashpot section 24. These two sections are bolted together by means of flanges 25. A top plate 26 is affixed to flange 27 at the top of guide section 23, and engages the top deck of the pool and is anchored thereto to impart stability to the guide tube assembly. Obviously, other or additional anchoring means may be employed, such as tie rods and brace plates along the length of tube 20.

The cylindrical wall of guide section 23 is formed with an axially extending opening 28, running from the top plate 26 to the flange 25. The purpose of opening 28 is to enable spent fuel elements to be manipulated by hoist mechanisms and the like from the deck of the pool, to enable the fuel elements to enter the guide tube while being retained under water, for insertion in a cask 10 that has been positioned at the bottom of the guide tube 20 in the dashpot section 24. The dashpot section 24 is completely circumambient, and is provided with four columns of regularly spaced apertures 29. These apertures function as dashpot ports, as will be explained subsequently.

For illustration purposes, in an actual embodiment the cask 10 might weigh approximately 100 tons, and be approximately 15 feet in height and 6 to 7 feet in diameter. Base plate 13 is substantially larger in diameter, and may be for example 119 inches. The pool 21 may be about forty feet deep, and the overall height of the guide tube 20 would be approximately the same, with the dashpot section 24 being about 16 feet in height and the guide section 23 being approximately 24 feet. With a 119 inch diameter for base plate 13, the internal diameter of the guide tube 20 would be selected to be about 120 inches. Preferably, the guide tube 20 and base plate 13 would be fabricated from stainless steel.

In the practice of the present invention, an empty fuel cask 10 is prepared for lowering in tHe pool by affixing the base plate 13 to the bottom thereof. The yoke 11 is also applied to the lugs 12, and the assembly is hoisted and positioned over the top opening 30 of the guide tube. The assembly is then lowered into the guide tube, and descends therein as shown in FIG. 3. Because of the open channel 28 in the wall of guide section 23, very little dashpot effect is had until the base plate enters the dashpot section 24. At that time, because of the close clearance between the base plate rim and the internal surface of the guide tube, and because of the limited exit area for pool water through the dashpot ports 29, continued descent of the cask assembly is slowed and cushioned. As the base plate passes successive sets of dashpot ports 29, the exit area for water within the tube section 24 and below the base plate 13 is decreased, thereby increasing the dashpot effect. Thus, once a cask assembly has started its descent into the guide tube 20, should it break loose from its crane or hoist, its descent into the pool 21 will be guided by the tube 20, thereby protecting the storage racks and spent fuel assemblies in the pool. Furthermore, the dashpot effect of the guide tube will control the rate of descent of the cask assembly, and will cushion its ultimate impact with the floor of pool 21, thereby protecting the pool and the cask itself from serious damage.

Once the cask assembly has been positioned at the bottom of pool 21, the yoke 11 and top cover of the cask are removed. Spent fuel assemblies stored on the racks in the pool are then transported by a suitable fuel handling crane from the racks, through the open channel 28 in the wall of guide section 23, and then down into the interior of the cask. Because of the height of water above the top of the cask, this entire operation can be conducted with the spent fuel assemblies under water at all times, for radiation shielding. After the desired spent fuel assemblies are loaded into the cask, the cask cover and hoist assembly yoke are again affixed to the cask, and the cask assembly is lifted up the guide tube and out of the pool. Obviously, if the cask assembly should break loose during this hoisting operation, the above described action of the guide tube would protect the pool and cask from damage.

It is suggested in the foregoing description that the guide tube 20 be cylindrical with a uniform internal diameter along its entire length. Alternatively, the guide tube could be uniformly tapered with its largest diameter at the top and its smallest diameter at the bottom, which would facilitate initial insertion of the cask assembly at the top of the guide tube and contribute to a gradually increasing dashpot effect as the cask descended toward the bottom of the pool. Or, if preferred, a taper could be introduced only near the bottom of the guide tube, to contribute to an increasing dashpot cushion effect at that point. Also, it may be desired to insure that if the cask assembly should break loose from its hoist or crane mechanism, it does not cant or tilt in the guide tube during its descent. This result could be insured by providing an upstanding rim or skirt around the periphery of base plate 13. Coaction between this skirt or rim and the guide tube 20 would constrain the cask assembly to a substantially vertical orientation at all times.

Figure 4:
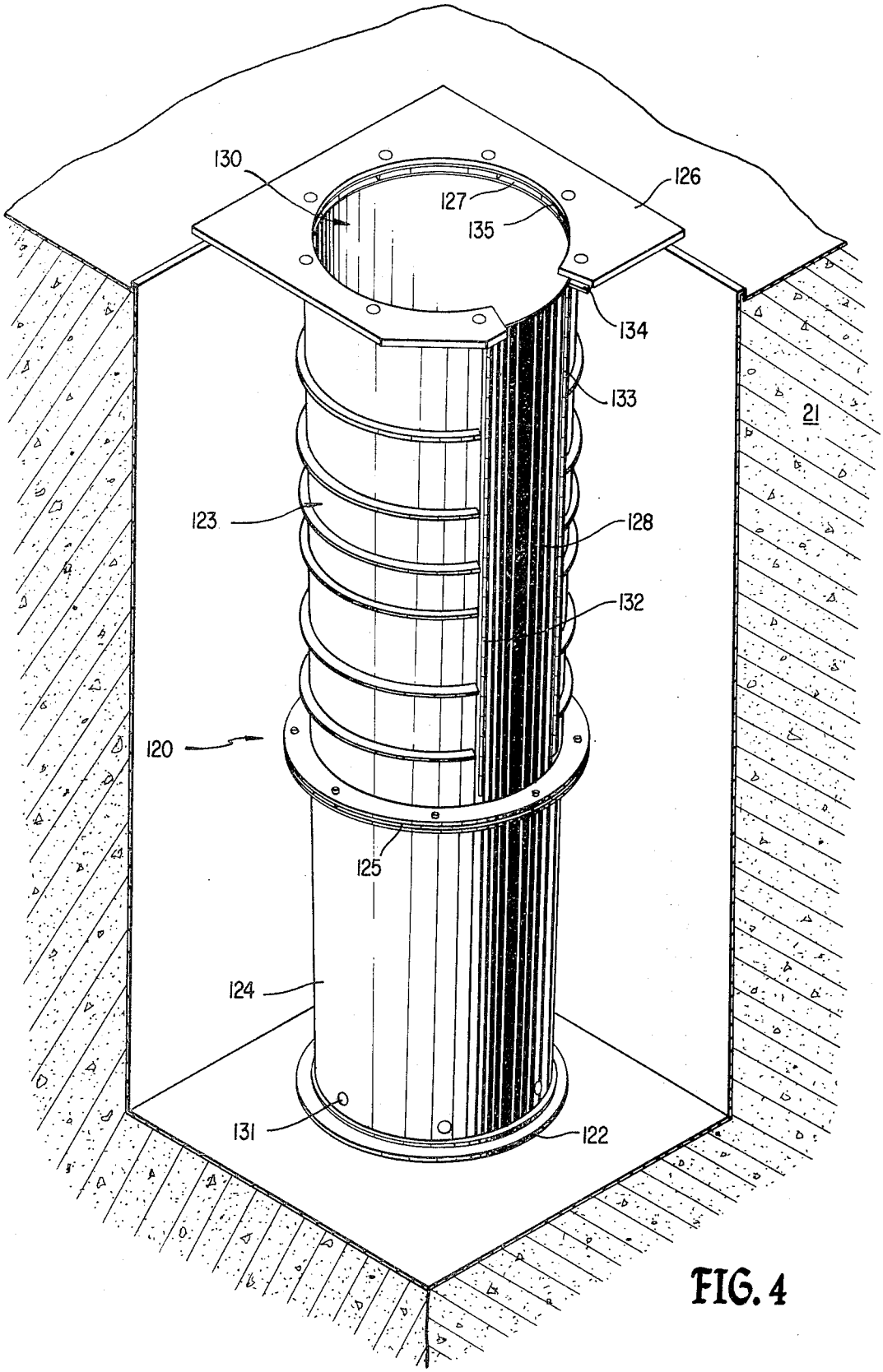
FIG. 4 is an isometric view of a second embodiment of a guide tube which may be utilized in the practice of the present invention.

The embodiment of the invention illustrated in FIG. 4 incorporates the axial taper concept suggested above. FIG. 4 being an isometric view, shows a taper of a continuously and uniformly decreasing diameter for the guide tube 120, from a maximum diameter at the top opening 130 to a minimum diameter at the bottom adjacent the reInforcing plate 122. As in the preceding embodiment, guide tube 120 includes an upper section 123 which functions primarily as a guide section, and a lower section 124 which functions primarily as a dashpot section. The two sections 123 and 124 are bolted together by flanges 125, and extend from the reinforcing plate 122 on the bottom or floor of the spent fuel pool 21, to the top of the pool. The guide tube 120 is again preferably positioned in a corner of the pool 21, and at the top is provided with a top plate 126 affixed to flange 127 of the tube. This top plate 126 provides an extension of, or bridge from the pool deck to the rim of the guide tube 120. In addition, the top plate may function to anchor the top of the tube 120 to the concrete structure of the pool 21, although it is apparent that other means, such as tie rods, braces and the like, may also be employed for anchoring the tube to the pool structure.

In addition to the axial taper, guide tube 120 in FIG. 4 differs from guide tube 20 in FIG. 2 in two additional material respects. The dashpot section 124 does not contain the apertures 29 shown in FIG. 2; and the open slot 28 in the guide section 23 of FIG. 2 is shown in FIG. 4 as closed by a hinged door 128. Thus, the guide tube 120 is essentially closed to the surrounding pool environment, and this has the advantage of protecting spent fuel racks in the pool from potential damage from rushing water, should the fuel cask break loose during its insertion in, or removal from the guide tube.

The door 128 is shown as hinged at 132 along one edge. The opposite edge has a similar hinge type structure at 133, except that the pin 134 is removable. With pin 134 removed, the door 128 is readily swung open on hinge 132, to provide clear access to the interior of the guide tube, as in the embodiment of FIG. 2.

In the embodiment of FIG. 4, the increasing dashpot effect for a fuel cask 10 carrying a base plate 13, as it descends in the guide tube 120, is dependent entirely on the taper of the guide tube and the movement of pool water between the edge of the descending plate 13 and side of the tube 120. For illustrative purposes, an effective dashpot relationship is obtained for a 100 ton fuel cask, by using a base plate 13 having a diameter of 110 inches, and a guide tube 120 having a height of 40 feet and a diameter at the upper opening 130 of 130 inches tapering uniformly to a diameter at the bottom of 110.5 inches. The top plate 126 may have a somewhat smaller opening than the adjacent upper end of tube 120, and may conveniently have an opening of about 120 inches in diameter, which is sufficiently large to permit the ready insertion of the 110 inch base plate 13. It will thus be seen that once a cask 10 and base plate 13 assembly is positioned in tube 120, should the assembly break loose, its free fall will be restrained by a gradually increasing dashpot effect as the plate 13 descends into the decreasing diameter taper of tube 120. Relief ports 131 are provided at the bottom of tube 120 to permit water to enter and exit from said tube in order to facilitate installation and removal of the tube from the pool.

In addition, further energy absorbing construction may be utilized with the guide tube structure. For example, crushable hollow steel bricks or tubes 135 may be positioned between the top plate 126 and the upper flange 127 of tube 120, to cushion any impact of the cask assembly with the top plate 126. Similar energy absorbing structure may be applied along the inside of the upper guide section 123 of tube 120, to cushion impacts along the side of the tube from a falling or misaligned cask assembly. Such energy absorbing elements may also be used in association with the structure for anchoring or bracing the tube 120 to the walls of the pool structure 21; and they may be likewise positioned on the reinforcing plate 122 at the bottom of tube 120, to receive the final impact of the cask assembly as it settles at the bottom of tube 120.

In the foregoing description of FIG. 4, the tube 120 is described and shown as having a continuous axial taper from the top to the bottom. If desired, the top guide section 123 may by cylindrical without any taper, and the bottom dashpot section 124 may alone embody the taper. Also, particularly in this latter instance, it may be beneficial to utilize a compound taper, by which is meant that different tapers may be used at different portions of the tube. For example, a relatively shallow taper may be employed over most of the length of the tube, followed by a more abrupt taper near the bottom of the tube, and the very last increment of travel may be defined by a non-tapered cylindrical section.

The basic purpose of the present invention is to provide for the safe insertion and removal of a nuclear fuel cask into and out of a spent fuel pool, so that spent fuel may be inserted in the cask and removed from the pool. Because of shielding, these casks are very heavy, and if dropped, can cause extensive damage to the pool, and to the racks of spent fuel in the pool. Heretofore, the description of the invention has addressed the function of the guide tube in cushioning the descent of a cask should it break loose from its crane and hoist during the time it is being raised or lowered in the guide tube. The present invention further contemplates a method of approaching the guide tube, so that if the cask breaks loose before it is located in the guide tube, it will not fall into the pool.

Figure 5:
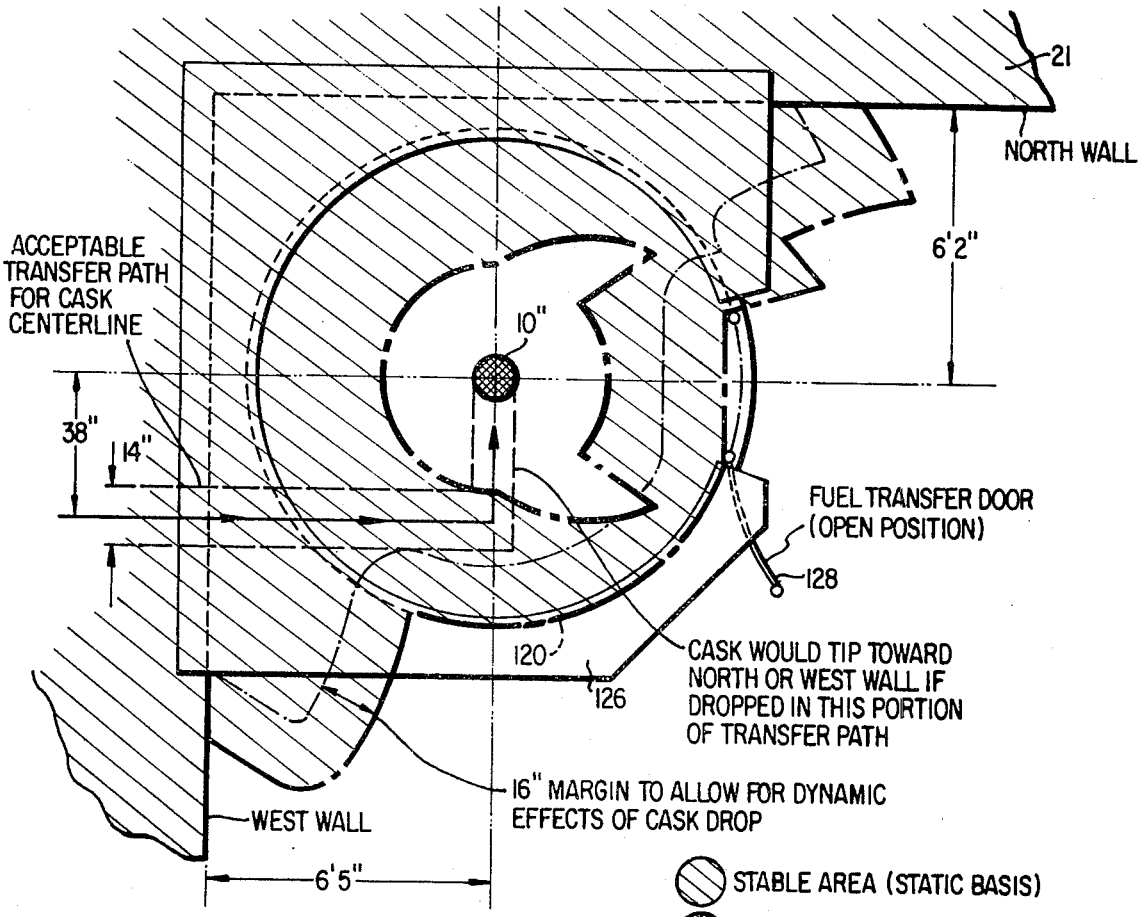
FIG. 5 is a top plan view of the guide tube embodiment shown in FIG. 4, and further illustrating a safe approach path to the guide tube for the fuel cask assembly and the area of stable support for the assembly.

Reference to either FIGS. 2 or 4 will reveal that if the cask is brought straight from the deck of the pool over the top plate 26 or 126 into alignment with the opening of the guide tube, there is a substantial portion of the travel path begining at some point after the center of gravity of the cask assembly has passed over the lip of the top plate, where the cask assembly would fall into the pool if it were to break loose. Much less damage would be incurred if on such an accident it were assurred that the cask assembly would always fall toward an adjacent pool deck, rather than away from the pool deck and into the pool itself. FIG. 5 is a top plan view of the structure shown in FIG. 4, and illustrates a path of approach to the guide tube 120 from the deck of the pool, wherein there is no portion of travel where the cask would fall into the pool if dropped.

In FIG. 5, for purposes of descriptive reference, the guide tube is assumed to be located in the northwest corner of the pool, and a north wall and a west wall are indicated for the pool corner. The hatched portion of the drawing defines the area where the assembly of cask and base plate assembly would find stable static support, if the assembly center of gravity is located therein. In determining the hatched area, only the pool deck and the guide tube rim are considered as support areas — the top plate 126 and the door 128 are ignored. The double hatched portion designates the area of location for the centerline of the cask assembly for insertion into the guide tube. The unhatched areas indicate positions where the cask assembly would not find stable support and would tip. The dot-dash line within and following the perimeter of the hatched area designates a safe margin within the stable support area to account for lateral momentum of the cask assembly should it be dropped during transport. The dimensions provided in FIG. 5 are applicable to the illustrative structural dimensions stated above with reference to FIG. 4.

Thus, it will be seen from FIG. 5 that the safe transport path for the cask and base plate assembly is for the center of gravity of the assembly to remain within the path boundaries defined by the dash lines. By retaining the center of gravity of the cask and base plate assembly within these boundaries, should the assembly be dropped as a result of crane or hoist failure, for most of the path the assembly will find stable support and will not fall over. Should the assembly be dropped while the center of gravity is over the unhatched portion of said path, it would fall toward the north or west deck of the pool and not into the pool. Should the assembly be dropped while its centerline is over the double hatched portion of the path, it will enter the guide tube 120. Thus, in general, the safe path may be defined as running eastward from the west wall of the pool along a line located to the south of the central axis of the guide tube, to a point substantially due south of said central axis, and thence northward substantially to said central axis of the guide tube, whereupon the cask assembly is lowered into the guide tube.

Figure 7:
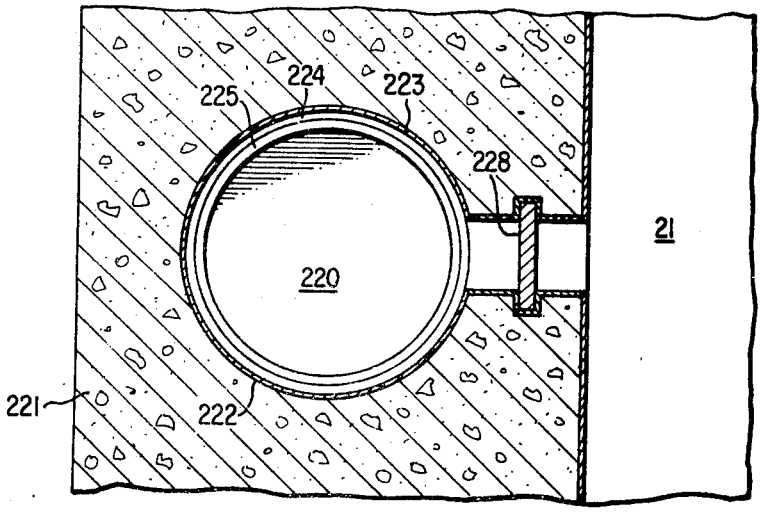
FIG. 7 is a cross sectional view of the guide tube, taken along the line 7—7 of FIG. 6.
Figure 6:
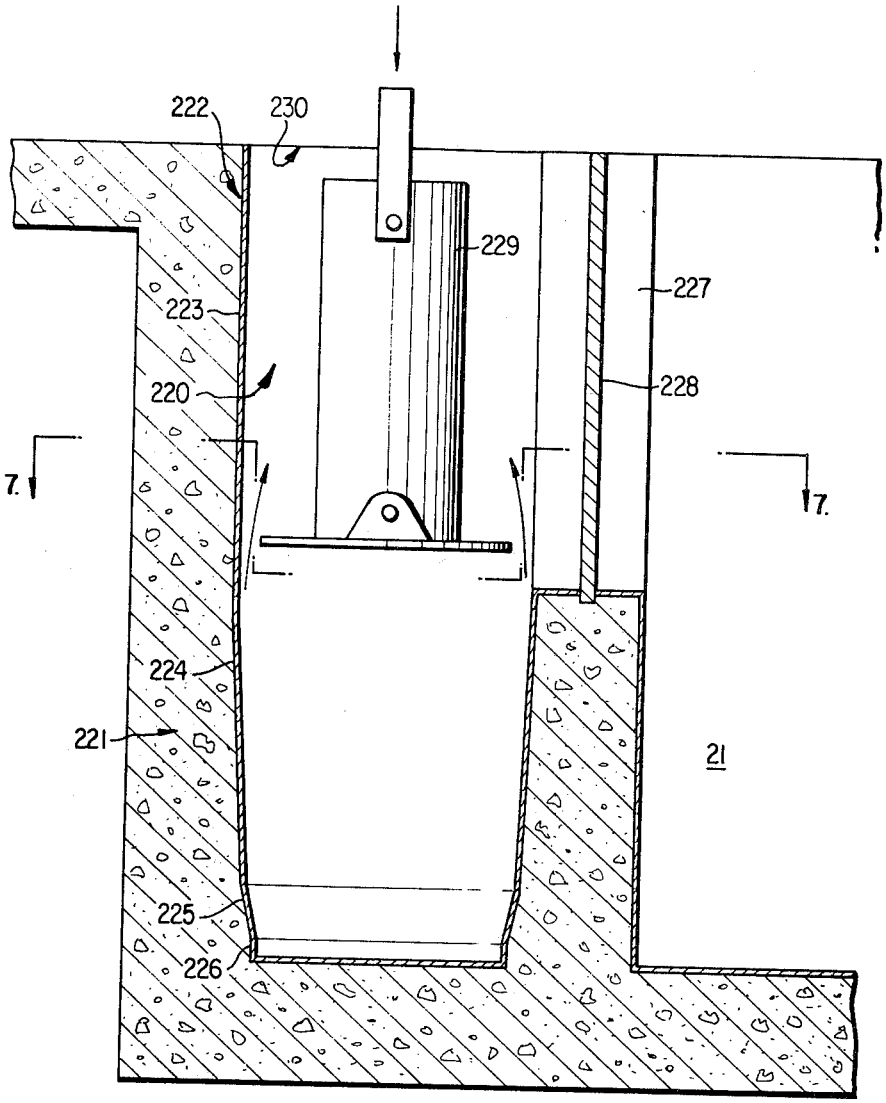
FIG. 6 is a vertical sectional view of a third embodiment of a guide tube which may be utilized in the practice of the present invention.

Still another embodiment of the invention is illustrated in FIGS. 6 and 7. In this embodiment a guide tube 220 is provided in a specially formed section 221 integral with the main spent fuel pool 21. The pool is formed of concrete or the like with a stainless steel liner, as in the preceding embodiments, and is provided with a niche type of recess at 222 having an open top at 230. An elongate passageway 227 is formed from the top of the pool down to about half the depth of the pool, between the main pool section 21 and the niche 222. The structure and dimensions of the niche 222 define the guide tube 220 for receipt of the fuel cask and base plate assembly indicated at 229. The passageway 227 between the main pool and the niche is opened and closed by means of removable gate 228.

In the embodiment shown, the top half of the guide tube 220 is formed as an untapered cylindrical guide section 223, while the bottom half is formed with a compound taper to provide a dashpot section. The major length of the dashpot section provides a gradual taper at 224, and near the bottom provides an increased taper at 225, while the final section is untapered and has a dimension that is only slightly greater than that of the base plate of the fuel cask assembly 229.

As in the preceding embodiments, the fuel cask assembly 229 is lowered into the guide tube 220 through the mouth 230 at the top, while the gate 228 is closed. If during the lowering or raising of the assembly 229, it breaks loose from the crane or hoist mechanism, it will be guided to the bottom of the guide tube, and its fall will be controlled and cushioned by the dashpot effect experienced primarily in the tapered section 224, 225, and 226 of the guide tube 220.

After the cask assembly 229 is lowered to the bottom of the guide tube 220, the gate 228 is removed to open the passageway 227 between the guide tube and main spent fuel pool 21, at which time appropriate hoist and handling mechanisms can be used to transfer fuel elements between the cask and the pool.

Having thus described in detail several specific embodiments of the invention, it is likely that various modifications will become apparent to those skilled in the art. All modifications or variations that are embraced by the spirit and scope of the appended claims are contemplated as being within the purview of the present invention.

What is claimed is:

1. In a method for inserting a nuclear fuel cask into a nuclear fuel pool, wherein the pool comprises two side walls forming a corner, a deck associated with each of said side walls, and a guide tube positioned in the area of said corner and extending substantially from the level of said decks to the bottom of said pool; the improvement comprising moving the fuel cask from a position over the deck associated with a first of said side walls to a position centrally located over said guide tube, by guiding the cask along a path that extends from and is substantially perpendicular to said first side wall to a location that lies substantially on a line perpendicular to the second of said side walls and which passes through the axis of said guide tube, said axis lying between said second side wall and said location, said path further extending from said location to a point substantially coincident with said axis.

2. In a method as set forth in claim 1, said cask being guided to retain its center of gravity on said path.

3. In a method as set forth in claim 2, said location being inside the perimeter of said guide tube.

4. In a method as set forth in claim 3, said cask having a substantially flat bottom surface smaller than but substantially coinciding with the cross-section of said guide tube.

5. In a method as set forth in claim 1, said cask having a substantially flat bottom surface smaller than but substantially coinciding with the cross-section of said guide tube.

6. In a method for withdrawing a nuclear fuel cask from a nuclear fuel pool, wherein the pool comprises two side walls forming a corner, a deck associated with each of said side walls, and a guide tube positioned in the area of said corner and extending substantially from the level of said decks to the bottom of said pool; the improvement comprising moving the fuel cask from a position centrally located over said guide tube to a position over the deck associated with a first of said side walls, by guiding the cask along a path that extends from a point centrally located over said guide tube along a line substantially perpendicular to the second of said side walls to a location wherein said point lies between said location and said second side wall, said path further extending from said location to said first side wall along a line substantially perpendicular to said first side wall.

7. In a method as set forth in claim 6, said cask being guided to retain its center of gravity on said path.

8. In a method as set forth in claim 7, said location being inside the perimeter of said guide tube.

9. In a method as set forth in claim 8, said cask having a substantially flat bottom surface smaller than but substantially coinciding with the cross-section of said guide tube.

10. In a method as set forth in claim 6, said cask having a substantially flat bottom surface smaller than but substantially coinciding with the cross-section of said guide tube.

* * * * *